United States Patent [19]

Hoffman

[11] Patent Number: 4,776,460

[45] Date of Patent: Oct. 11, 1988

[54] PACKAGE STRUCTURE

[76] Inventor: Arlan Hoffman, 5137 Coldbrook Dr., Mantua, Ohio 44255

[21] Appl. No.: 101,012

[22] Filed: Sep. 24, 1987

[51] Int. Cl.[4] ..... B65D 85/14

[52] U.S. Cl. ..... 206/69; 229/40

[58] Field of Search ..... 206/69, 388, 37.2, 353, 206/800; 229/40

[56] References Cited

U.S. PATENT DOCUMENTS

| | | | |
|---|---|---|---|
| 1,901,830 | 3/1933 | Gaisman | 206/353 |
| 2,006,212 | 6/1935 | Grabler | 206/69 |
| 2,332,857 | 10/1943 | Karg | 206/69 X |
| 2,390,900 | 12/1945 | Schmid | 206/69 |
| 3,310,623 | 3/1967 | Vaughan | 150/52 R |

*Primary Examiner*—William Price

[57] ABSTRACT

A package is shown comprising a substantially rectangular, open-ended tube structure with resilient sides, the longer ends of the tube having an inwardly concave shape. The structure is particularly adapted for packaging individual product units intended for sale in coin operated vending machines.

4 Claims, 1 Drawing Sheet

FIG.-1
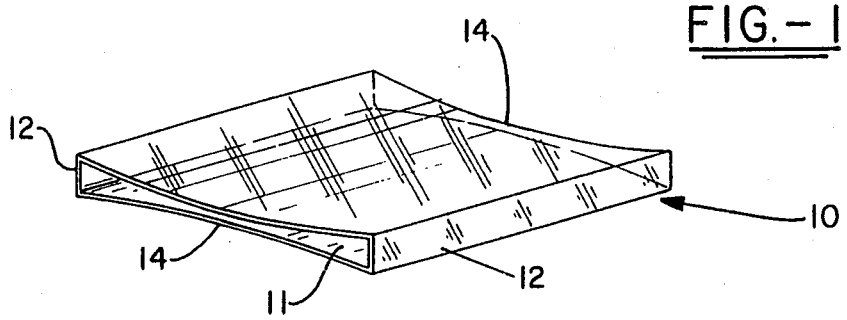
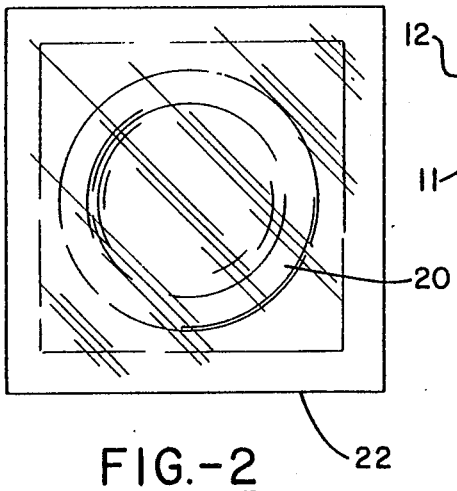
FIG.-2
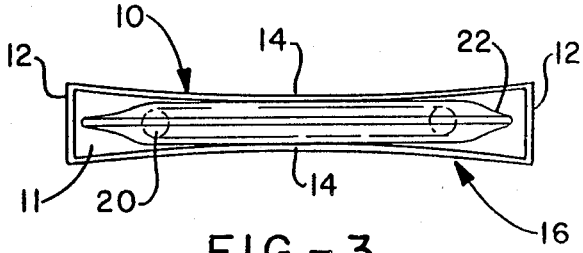
FIG.-3
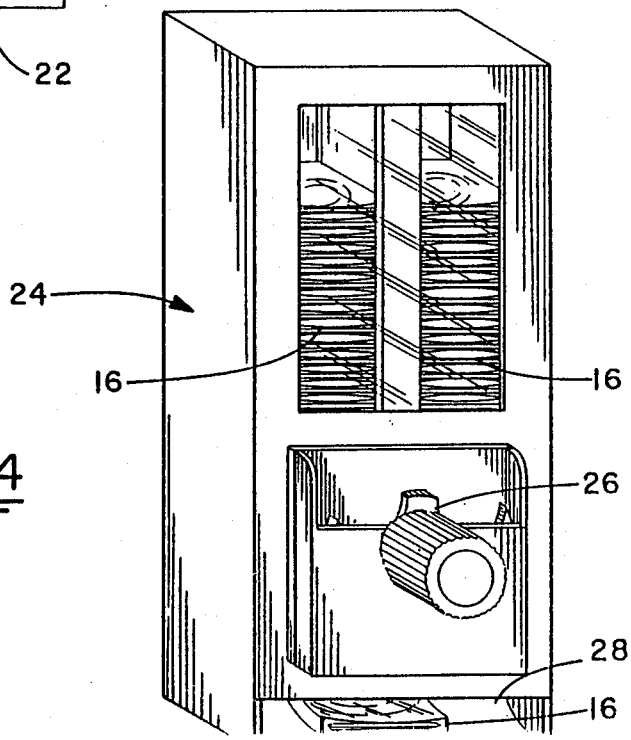
FIG.-4

PACKAGE STRUCTURE

TECHNICAL FIELD

This invention relates to a simplified packaging structure. More particularly, this invention relates to a packaging structure or container which facilitates the dispensing of articles from coin operated vending machines. Specifically, the invention relates to rectangular, open-ended, tube-shaped packages, the longer parallel sides of which are inwardly warped or curved to enable the inserted vended article in the tube to be retained within the tube.

BACKGROUND OF THE INVENTION

Not only is packaging an indispensable ingredient in the successful marketing of most products, but the nature of the packages employed frequently has an important influence on the products' sale. For instance, to an important degree, some products rely on the appearance of the packaged product to attract the eye of prospective purchases, while still others require the packages in which they are enclosed to have functional features which interact with the product during use. Packages with pouring spouts integrated therein are an example of the latter type. Still other forms of packages promote the handling of the product during the sale transaction, as for instance, awkwardly or irregularly shaped articles which are to be manipulated during the sale by mechanical devices, such as vending machines.

As important as the nature of the packaging used, however, is the packaging cost entailed, including that resulting from the effort involved in placing the product in the package.

While it sometimes happens that the product being sold is so expensive that the cost of packaging is immaterial in the overall economics of the sale transaction, and although in other instances, the proper and necessary functioning of the package outweighs cost considerations, as a general rule, package cost as well as package functionality, are normally both important, and product marketers attempt to find the least expensive package capable of meeting the other requirements for profitable sale of their products.

Unfortunately, in the case of relatively low-cost products which require point-of-sale packaging functionality, such as the ability to be processed mechanically by coin operated vending machines, package selection is oftentimes difficult. In such cases it is necessary that irregularly shaped articles be enclosed in a geometrically uniform package to facilitate handling by machinery capable only of standardized motion. In addition, the package must meet specified parameters of procurement and insertion costs, as well as other requirements.

DISCLOSURE OF THE INVENTION

In view of the foregoing, a first objective of the herein described invention is to provide a package structure that lends itself to mechanical handling in a vending machine.

A second objective of this invention is to provide a machine-vendable package that is inexpensive to fabricate.

A further objective of the invention is the provision of a package structure within which the articles to be sold may be easily inserted, and within which they can be securely held.

Another objective of this invention is to make available a package structure which is both durable, and has an attractive appearance.

An additional purpose of the invention is to provide a package for condoms which permits them to be dispensed from coin operated vending machines.

These and other objects of the invention are provided by a package container for holding vended articles comprising a substantially rectangular, open-ended tube structure possessing resilient sides, the longer sides of said structure having an inwardly concave shape, and being adapted to press against articles inserted therein, thereby holding said articles securely within said structure.

BRIEF DESCRIPTION OF THE DRAWINGS

The invention will be better understood when reference is had to the following drawings, in which like numbers indicate like parts.

FIG. 1 is an isometric view of the packaging device of the invention.

FIG. 2 shows a plan view of a condom in its original package.

FIG. 3 is an end view of the packaged condom of FIG. 2, inserted in the packaging device of the invention.

FIG. 4 shows an isometric view of the packages of FIG. 3 disposed in a coin operated vending machine.

BEST MODE FOR CARRYING OUT THE INVENTION

FIG. 1 shows an isometric view of the packaging structure of the invention, indicated generally by the numeral 10. The package consists of a tube-like structure having open ends 11, relatively short, flat sides 12, and longer sides 14 which are formed in an inwardly concave shape. The packaging structure 10 is readily loaded with the product to be sold by forcing the longer sides 14 of one of the open ends 11 apart, and inserting the product sufficiently far so that it is entirely enclosed by the sides. Release of the sides 14 allows them to resume their originally inwardly concave shape, pressing against the product and holding it securely in place. Removal of the product is easily accomplished by reversing the process described.

The packaging structure 10 may be manufactured in whatever size is needed to hold the vended product. In the case of some articles such as, for example, birth control devices known as "condoms", the package will be from about 2 to 3 inches square, and have short sides about ¼ inch high. The concave longer sides 14, extending from the sides 12 typically will have a concave shape sufficient to provide a clearance of about ⅛ inch between such sides, at their center. The latter clearance is slightly less than the height of a wrapped, rolled condom, and thus is able to hold it securely within the packaging structure. The fact that the four corners of the package structure 10 have the same height permits the packages to be arranged in stable, vertical stacks, an important advantage in dispensing them in a coin operated vending machine.

While the packaging structure 10 may be made in various ways, a simple, inexpensive process involves the extrusion of a tube having the desired transverse cross-sectional shape, and its subsequent processing, for example, through a guillotine cutter, to achieve package structures of the required length.

The package structures of the invention may be made from any suitably resilient material; however, their fabrication from plastic materials is of advantage, since plastics are usually relatively inexpensive, sufficiently resilient, and easy to cut, particularly when they are provided with a wall thickness of from about 10 to 20 mills, the preferred range. Fabrication of the packaging structures 10 from plastic also provides a smooth surface, making the lateral displacement of the packages by the dispensing machinery easy to accomplish. Among satisfactory materials may be mentioned polyethylene, polypropylene, polyvinylchloride, polyesters, polystyrene, butyrate plastics, and others. If desired, the plastic employed may be pigmented to provide a desired color, or in cases where the plastic is normally transparent, for example, polystyrene, the material may be left in its transparent state to allow advertising on the product's original wrapping to be viewed through the packaging structure.

FIG. 2 illustrates a plan view of a rolled condom 20, packaged in an original wrapping 22. The vended product can either be prepackaged in an original package before insertion into the packaging structure of the invention, or in some cases it may simply be inserted without prior packaging. While the invention is primarily illustrated herein in connection with the vending of condoms, other products may also be vended in the packaging structure, for example, items including, but not limited to packets of coffee, chocolate, aspirin, and so forth.

FIG. 3 is an end view of the packaged condom of FIG. 2 inserted in the packaging structure 10 of the invention. In the Figure, a vendably packaged condom, generally 16 is shown comprising a rolled condom 20, enclosed in its original wrapping 22, the whole being inserted in a packaging structure 10 of the invention.

A considerable advantage of the invention is that products such as, for instance, individually wrapped condoms, commonly come in multi-unit packages. Their vending from machines, however, is usually done on a single unit basis. The ease with which such individual units can be repackaged in the packaged structure 10 facilitates "break-bulk" operations in which multi-unit packages are purchased and repackaged in individual units.

FIG. 4 shows an isometric view of the packaged condoms 16 loaded in vertical stacks in a coin operated vending machines 24. Individual packages are dispensed by inserting the proper coins in the coin mechanism 26, which upon rotation, causes the units to be pushed laterally from the bottom of the stack by a dispensing mechanism, not shown, allowing them to fall into the dispensing chute 28 where they are accessable to the purchaser. While the packages 16 are shown in uniform, horizontal orientation, the fact that the four edges of the package have the same height, as previously referred to, also permits the packages to be disposed in mixed horizontal orientation, e.g., in which some of the packages are stacked in a horizontal plane at right angles to the others.

While in accordance with the patent statutes, a preferred embodiment and best mode has been presented, the scope of the invention is not limited thereto, but rather is measured by the scope of the attached claims.

What is claimed is:

1. A package container for holding vended articles comprising a four-sided, open-ended tube structure possessing resilient sides, opposite longer sides of said structure having inwardly concave shape, and being adapted to press against articles inserted therein, thereby holding said articles securely within said structure, while opposite shorter sides of said structure are straight.

2. The package container of claim 1 wherein said tube structure is made from plastic.

3. The process of dispensing the package containers of claim 1 from a coin operated vending machine.

4. The package container of claim 1 wherein the vended article is a condom

* * * * *